US005690538A

United States Patent [19]

Haas

[11] Patent Number: 5,690,538

[45] Date of Patent: Nov. 25, 1997

[54] METHOD OF SHAPING AND POLISHING JEWELRY FROM SHELLS

[76] Inventor: Eugene A. Haas, Box 210 Gehris Rd. R.D.#4, Boyertown, Pa. 19512

[21] Appl. No.: 767,143

[22] Filed: Dec. 16, 1996

[51] Int. Cl.[6] ..... B24B 1/00

[52] U.S. Cl. ..... 451/32; 451/34; 451/57; 29/896.41

[58] Field of Search ..... 451/32, 34, 57; 29/896.41, 896.4, 196; 125/30.01

[56] References Cited

U.S. PATENT DOCUMENTS 4,783,975 11/1988 Komatsu et al. ..... 63/32

5,571,558 11/1996 Nguyen et al. ..... 451/32

5,582,533 12/1996 McPherson ..... 451/32

*Primary Examiner*—Robert A. Rose

*Assistant Examiner*—George Nguyen

[57] ABSTRACT

A new Method of Shaping and Polishing Jewelry from Shells for making jewelry from shells thereby providing an aesthetically pleasing piece of jewelry. The inventive device includes grinding a shell approximately into a desired shape, tumbling the shell in a coarse grade material, then tumbling in a semi-coarse grade material, then tumbling in a fine grade polishing material, and thereafter securing to an article of jewelry. This method makes assorted types of jewelry such as necklaces, pendants, bracelets and earrings.

14 Claims, 3 Drawing Sheets

FIG 1
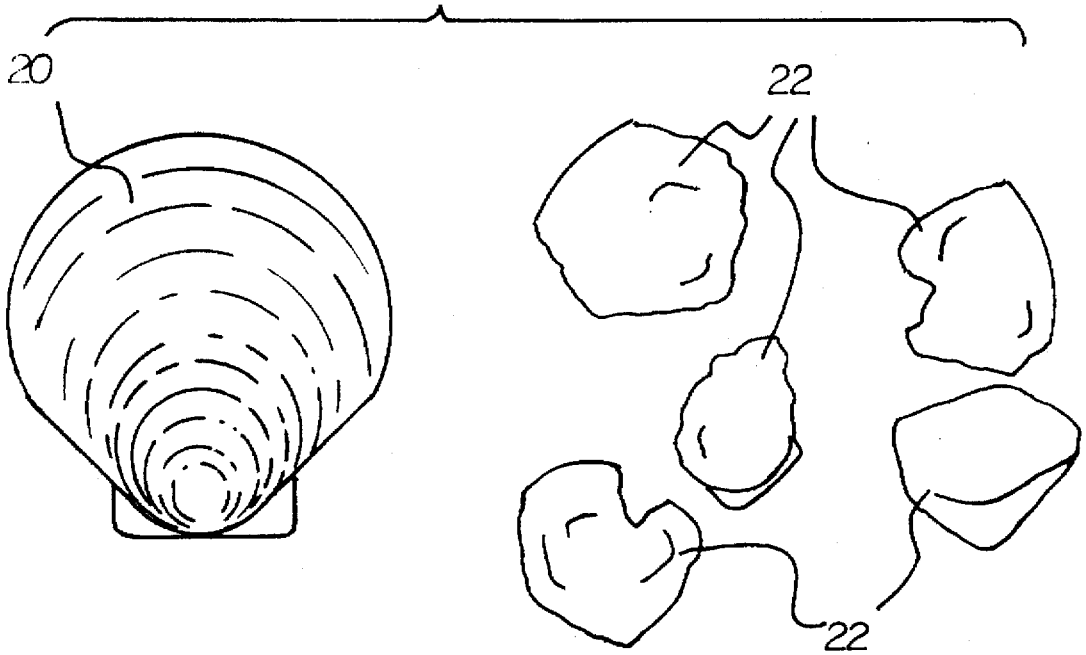
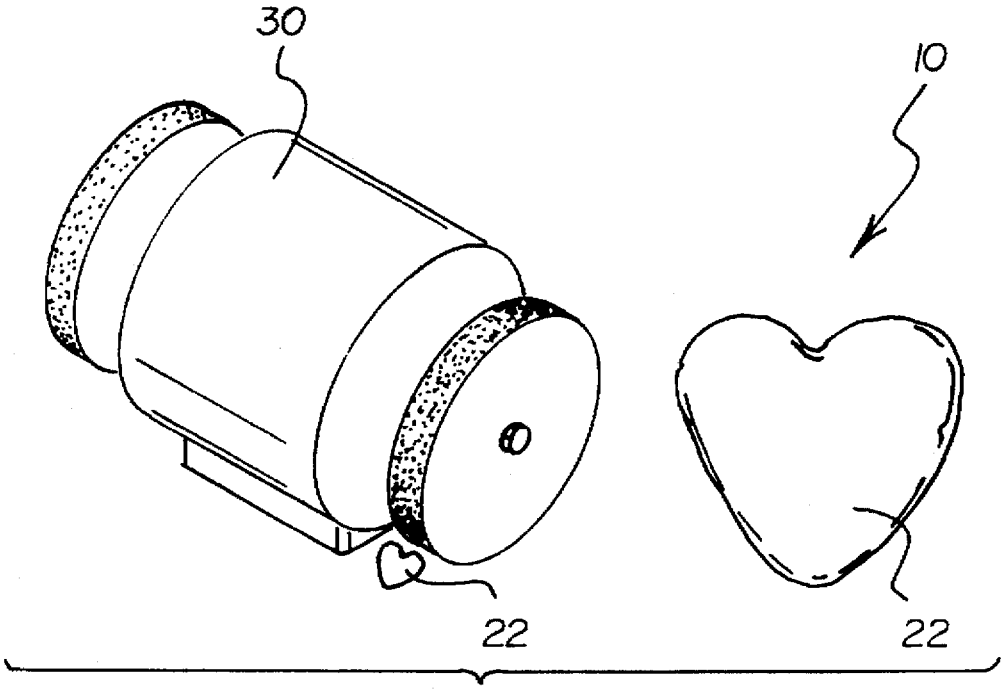
FIG 2

10

4
40
4
40

42
50
40
42

60
40
42

70

METHOD OF SHAPING AND POLISHING JEWELRY FROM SHELLS

BACKGROUND OF THE INVENTION

1. Field of the Invention

The present invention relates to Polishing Devices and more particularly pertains to a new Method of Shaping and Polishing Jewelry from Shells for making jewelry from shells thereby providing an aesthetically pleasing piece of jewelry.

2. Description of the Prior Art

The use of Polishing Devices is known in the prior art. More specifically, Polishing Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Polishing Devices include U.S. Pat. No. 4,979,378; U.S. Design Pat. No. 289,020; U.S. Design Pat. No. 269,863; U.S. Pat. No. 5,157,945; U.S. Pat. No. 4,154,282 and U.S. Pat. No. 4,018,008.

While these devices fulfill their respective, particular objectives and requirements, the aforementioned patents do not disclose a new Method of Shaping and Polishing Jewelry from Shells. The inventive device includes grinding a shell approximately into a desired shape, tumbling the shell in a coarse grade material, then tumbling in a semi-coarse grade material, then tumbling in a fine grade polishing material, and thereafter securing to an article of jewelry.

In these respects, the Method of Shaping and Polishing Jewelry from Shells according to the present invention substantially departs from the conventional concepts and designs of the prior art, and in so doing provides an apparatus primarily developed for the purpose of making jewelry from shells thereby providing an aesthetically pleasing piece of jewelry.

SUMMARY OF THE INVENTION

In view of the foregoing disadvantages inherent in the known types of Polishing Devices now present in the prior art, the present invention provides a new Method of Shaping and Polishing Jewelry from Shells construction wherein the same can be utilized for making jewelry from shells thereby providing an aesthetically pleasing piece of jewelry.

The general purpose of the present invention, which will be described subsequently in greater detail, is to provide a new Method of Shaping and Polishing Jewelry from Shells apparatus and method which has many of the advantages of the Polishing Devices mentioned heretofore and many novel features that result in a new Method of Shaping and Polishing Jewelry from Shells which is not anticipated, rendered obvious, suggested, or even implied by any of the prior art Polishing Devices, either alone or in any combination thereof.

To attain this, the present invention generally comprises grinding a shell approximately into a desired shape, tumbling the shell in a coarse grade material, then tumbling in a semi-coarse grade material, then tumbling in a fine grade polishing material, and thereafter securing to an article of jewelry.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Method of Shaping and Polishing Jewelry from Shells apparatus and method which has many of the advantages of the Polishing Devices mentioned heretofore and many novel features that result in a new Method of Shaping and Polishing Jewelry from Shells which is not anticipated, rendered obvious, suggested, or even implied by any of the prior art Polishing Devices, either alone or in any combination thereof.

It is another object of the present invention to provide a new Method of Shaping and Polishing Jewelry from Shells which may be easily and efficiently manufactured and marketed.

It is a further object of the present invention to provide a new Method of Shaping and Polishing Jewelry from Shells which is of a durable and reliable construction.

An even further object of the present invention is to provide a new Method of Shaping and Polishing Jewelry from Shells which is susceptible of a low cost of manufacture with regard to both materials and labor, and which accordingly is then susceptible of low prices of sale to the consuming public, thereby making such Method of Shaping and Polishing Jewelry from Shells economically available to the buying public.

Still yet another object of the present invention is to provide a new Method of Shaping and Polishing Jewelry from Shells which provides in the apparatuses and methods of the prior art some of the advantages thereof, while simultaneously overcoming some of the disadvantages normally associated therewith.

Still another object of the present invention is to provide a new Method of Shaping and Polishing Jewelry from Shells for making jewelry from shells thereby providing an aesthetically pleasing piece of jewelry.

Yet another object of the present invention is to provide a new Method of Shaping and Polishing Jewelry from Shells which includes grinding a shell approximately into a desired shape, tumbling the shell in a coarse grade material, then tumbling in a semi-coarse grade material, then tumbling in a fine grade polishing material, and thereafter securing to an article of jewelry.

Still yet another object of the present invention is to provide a new Method of Shaping and Polishing Jewelry from Shells that makes assorted types of jewelry such as necklaces, pendants, bracelets and earrings.

Even still another object of the present invention is to provide a new Method of Shaping and Polishing Jewelry from Shells that provides a shaped and polished shell with different features because of age rings which imitate fingerprints.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an upper perspective view of a new Method of Shaping and Polishing Jewelry from Shells according to the present invention.

FIG. 2 is an upper perspective view of a grinder and a shell piece.

DESCRIPTION OF THE PREFERRED EMBODIMENT

Figures 3, 4, 5, 6:
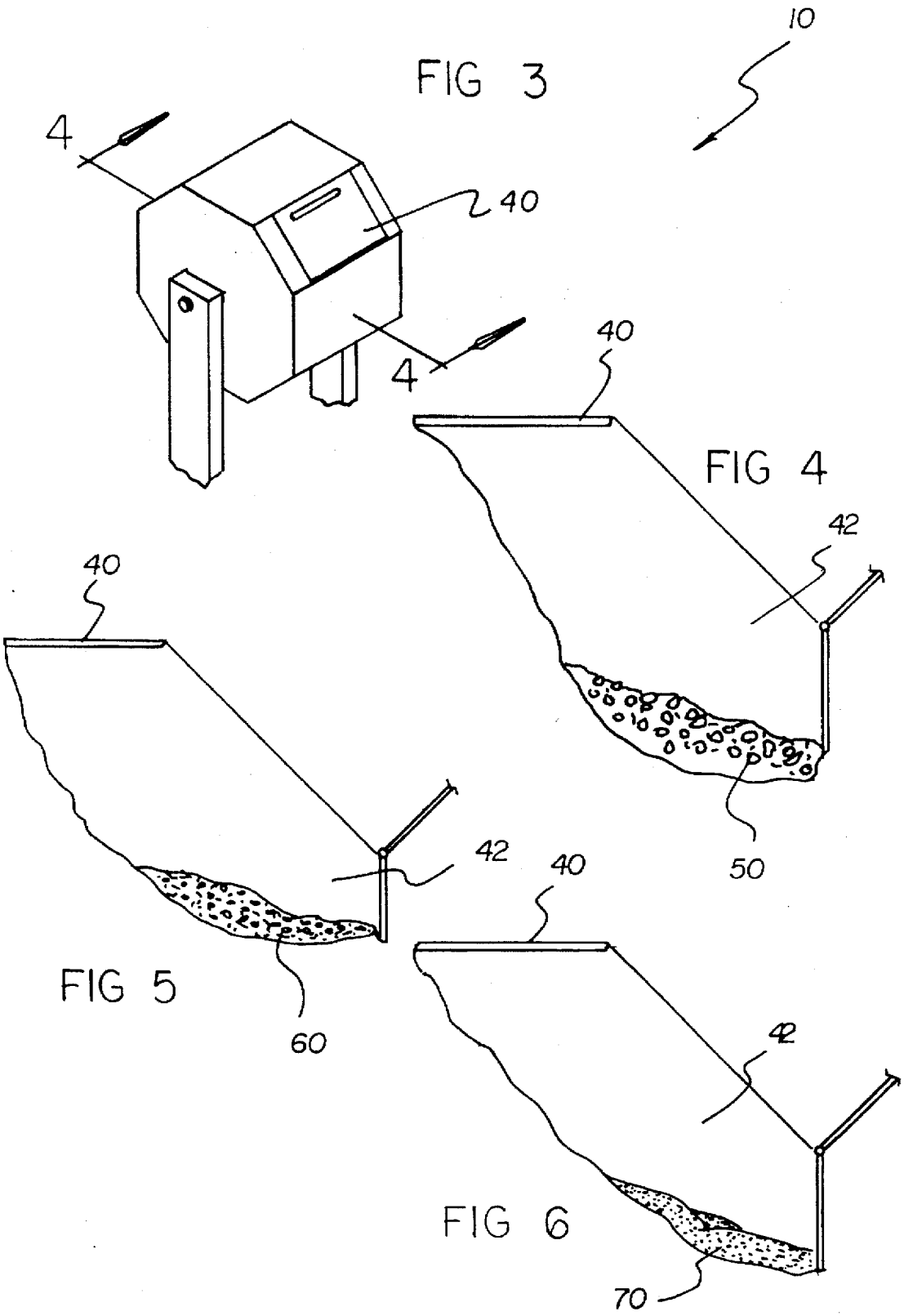
FIG. 3 is an upper perspective view of the tumbler.
FIG. 4 is a cross sectional view taken along line 4—4 of FIG. 3 disclosing a coarse grade material within the tumbler.
FIG. 5 is a cross sectional view taken along line 4—4 of FIG. 3 disclosing a semi-coarse grade material within the tumbler.
FIG. 6 is a cross sectional view taken along line 4—4 of FIG. 3 disclosing a fine grade polishing material within the tumbler.

With reference now to the drawings, and in particular to FIGS. 1 through 8 thereof, a new Method of Shaping and Polishing Jewelry from Shells embodying the principles and concepts of the present invention and generally designated by the reference numeral 10 will be described.

More specifically, it will be noted that the method of shaping and polishing jewelry from shells 10 comprises providing a whole shell 20 and breaking the whole shell 20 into a plurality of shell pieces 22 as shown in FIG. 1 of the drawings. The user thereafter grinds at least one shell piece 22 approximately into a desired shape with a grinder 30 to achieve the general desired shape as shown in FIG. 2 of the drawings.

Figure 7:
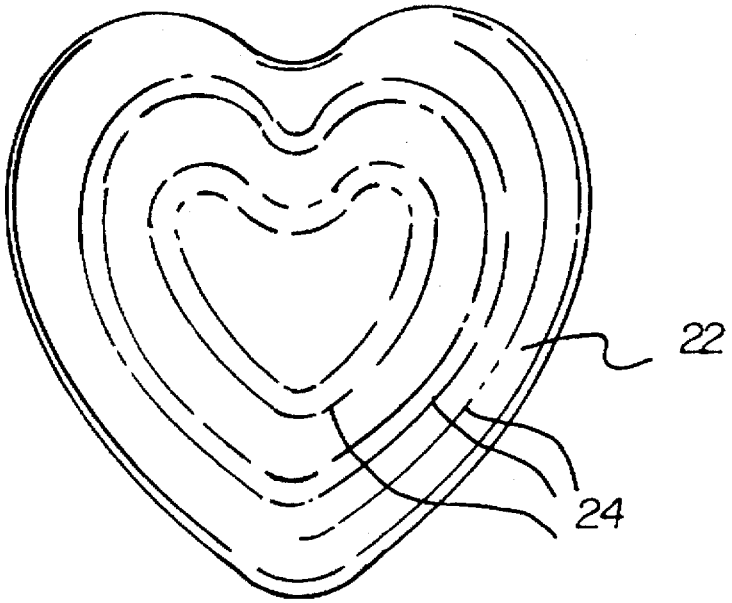
FIG. 7 is a front view of a shell piece after being shaped and polished disclosing the age rings.

As shown in FIGS. 3 through 6 of the drawings, the user tumble polishes at least one shell piece 22 within an interior chamber 42 of a tumbler 40 until a fine polish is developed upon the shell piece 22. The shell piece 22 is first tumbled within a coarse grade material 50 as shown in FIG. 4 of the drawings for approximately 48 hours within the tumbler 40. The coarse grade material 50 rounds any sharp or rough edges and surfaces. The shell piece 22 is then tumbled within a semi-coarse grade material 50 for approximately seven days as shown in FIG. 5 of the drawings. The semi-course grade material 50 further smoothens the surfaces and edges of the shell piece 22. The shell piece 22 is finally tumbled within a fine grade polishing material 70 for approximately seven more days as shown in FIG. 6 of the drawings. The fine grade polishing material 70 is for providing a glossy smooth finish to the shell piece 22. The resulting object is a finely polished shell piece 22 which exhibits the age rings 24 which naturally occur within the whole shell 20 such as a clam shell as shown in FIG. 7 of the drawings.

Figure 8:
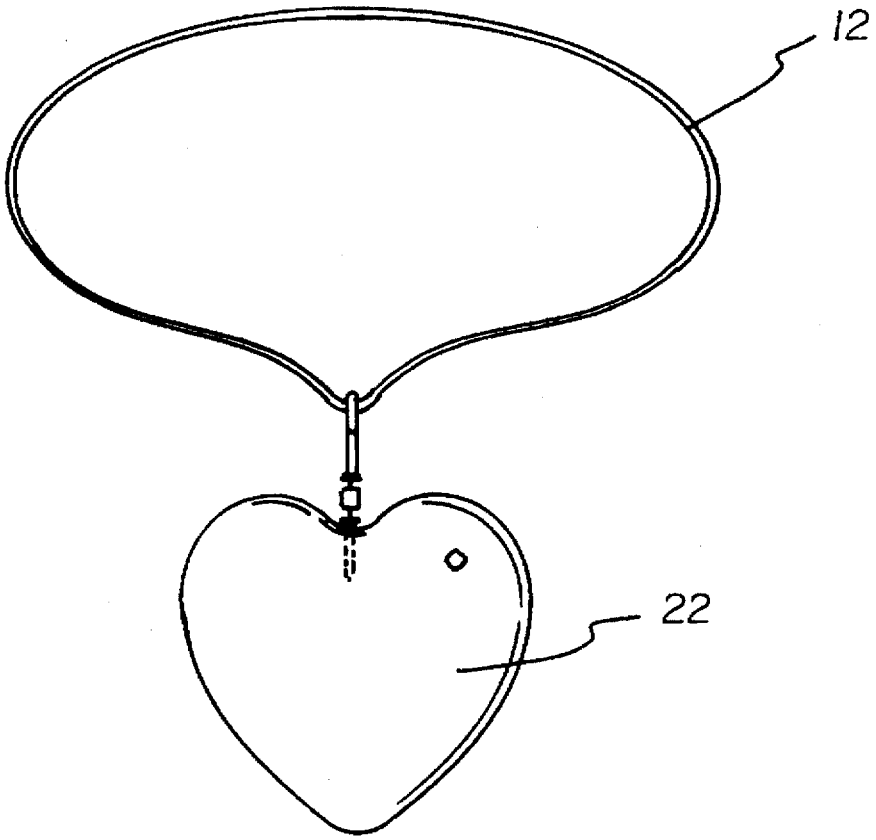
FIG. 8 is a front view of the shaped and polished shell piece secured to a necklace.

As shown in FIG. 8 of the drawings, the finely polished shell piece 22 is secured to an article of jewelry 12 for producing a necklace, a pendant, a bracelet or earring. Additional finished stones may be later secured to the shell piece 22 to provide a more aesthetically pleasing piece of jewelry.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of shaping and polishing jewelry from shells comprising:

(a) providing a whole shell;

(b) breaking said whole shell into a plurality of shell pieces;

(c) grinding at least one shell piece approximately into a desired shape; and (d) tumbling at least one shell piece until a fine polish is developed upon said shell piece.

2. The method of shaping and polishing jewelry from shells of claim 1, wherein said step of tumbling at least one shell piece includes:

(e) tumbling said shell piece within a coarse grade material;

(f) tumbling said shell piece within a semi-coarse grade material; and (g) tumbling said shell piece within a fine grade polishing material.

3. The method of shaping and polishing jewelry from shells of claim 2, wherein said step of tumbling said shell piece within a coarse grade material includes tumbling for approximately 48 hours.

4. The method of shaping and polishing jewelry from shells of claim 3, wherein said step of tumbling said shell piece within a semi-coarse grade material includes tumbling for approximately seven days.

5. The method of shaping and polishing jewelry from shells of claim 4, wherein said step of tumbling said shell piece within a fine grade polishing material includes tumbling for approximately for seven days.

6. The method of shaping and polishing jewelry from shells of claim 5, said method including the step of securing said shell piece to an article of jewelry.

7. The method of shaping and polishing jewelry from shells of claim 6, said method including the step of securing finished stones to said shell piece.

8. A method of shaping and polishing jewelry from shells comprising:

(a) providing at least one shell piece;

(b) grinding at least one shell piece approximately into a desired shape; and (c) tumbling at least one shell piece until a fine polish is developed upon said shell piece.

9. The method of shaping and polishing jewelry from shells of claim 8, wherein said step of tumbling at least one shell piece includes:

(d) tumbling said shell piece within a coarse grade material;

(e) tumbling said shell piece within a semi-coarse grade material; and (f) tumbling said shell piece within a fine grade polishing material.

10. The method of shaping and polishing jewelry from shells of claim 9, wherein said step of tumbling said shell piece within a coarse grade material includes tumbling for approximately 48 hours.

11. The method of shaping and polishing jewelry from shells of claim 10, wherein said step of tumbling said shell piece within a semi-coarse grade material includes tumbling for approximately seven days.

12. The method of shaping and polishing jewelry from shells of claim 11, wherein said step of tumbling said shell piece within a fine grade polishing material includes tumbling for approximately for seven days.

13. The method of shaping and polishing jewelry from shells of claim 12, said method including the step of securing said shell piece to an article of jewelry.

14. The method of shaping and polishing jewelry from shells of claim 13, said method including the step of securing finished stones to said shell piece.

* * * * *